US005677659A

United States Patent [19]

Porcher

[11] Patent Number: 5,677,659

[45] Date of Patent: Oct. 14, 1997

[54] LIMITED ANGULAR DEFLECTING TYPE ROTARY ELECTROMAGNETIC ACTUATOR

[75] Inventor: Yves Porcher, Le Plessis Bouchard, France

[73] Assignee: Societe D'Applications Generales D'Electricite et de Mecanique-Sagem, Paris, France

[21] Appl. No.: 408,849

[22] Filed: Mar. 23, 1995

[30] Foreign Application Priority Data

Mar. 25, 1994 [FR] France ..... 94 03532

[51] Int. Cl.[6] ..... H01F 7/08

[52] U.S. Cl. ..... 335/272; 335/229; 251/129.11; 308/10; 310/156

[58] Field of Search ..... 335/229, 230, 335/272; 251/129.11, 129.12; 308/10; 310/156, 17, 254, 266

[56] References Cited

U.S. PATENT DOCUMENTS

| | | | |
|---|---|---|---|
| 3,378,799 | 4/1968 | Ouellette . | |
| 4,082,376 | 4/1978 | Wehde et al. | 308/10 |
| 4,345,228 | 8/1982 | Idogaki et al. . | |
| 4,546,338 | 10/1985 | Idogaki et al. . | |
| 5,298,825 | 3/1994 | Oudet et al. | 310/254 |

FOREIGN PATENT DOCUMENTS

| | | |
|---|---|---|
| 0 463 590 | 1/1992 | European Pat. Off. . |
| 517.084 | 4/1921 | France . |
| 31 16 246 | 3/1982 | Germany . |
| 56-61102 | 5/1981 | Japan . |
| 1 262 855 | 2/1972 | United Kingdom . |

OTHER PUBLICATIONS

Hubertus Murrenhoff et al., "Proportional-Drehmagnet mit Integrierbarem Drehsensor", Othydraulik und Pneumatik, 37 (1993) Nr. 4, pp. 268–276.

*Primary Examiner*—Lincoln Donovan
*Attorney, Agent, or Firm*—Larson and Taylor

[57] ABSTRACT

An electromagnetic actuator rotatable about an axis including a stator magnet circuit (2) with an inner pole (9) having a central core (11), a first pole shoe (12) forming the continuation of the core at one axial end of the stator circuit and extending through an angle of approximately 180°, and a single coil (3) coaxially surrounding the central core (11), the core (11) and the coil (3) being off-center relatively to the axis of rotation; and an outer pole (10) having a lateral armature ($13_2$) in the form of a tubular sector outside the coil (3) and parallel to the core (11), and a second pole shoe (14) forming the continuation of the armature ($13_2$) at the axial end of the stator circuit and extending through an angle of approximately 180°; the ends of the central core (11) and of the armature (13) which are remote from the respective pole shoes being mutually in contact.

9 Claims, 2 Drawing Sheets

FIG.1.
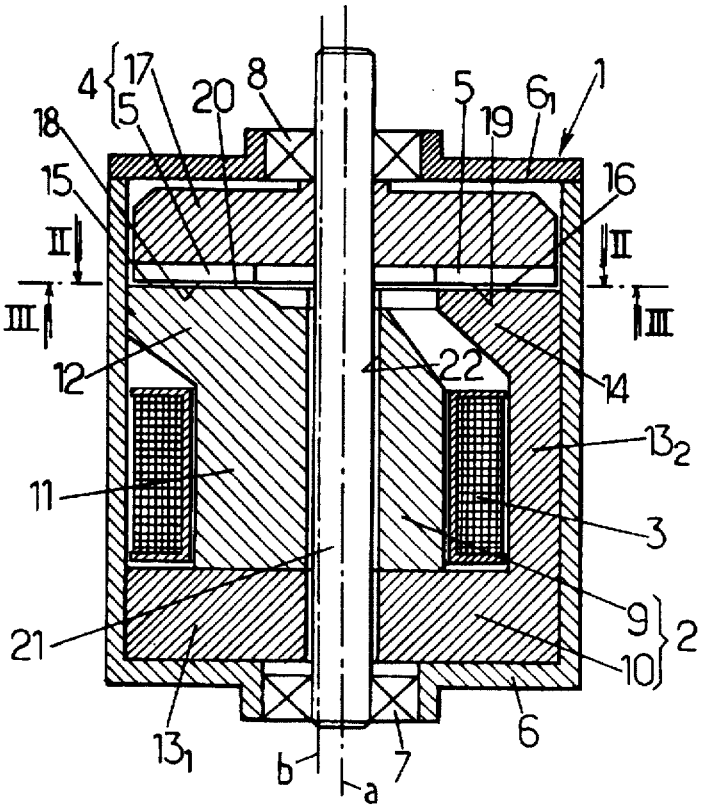
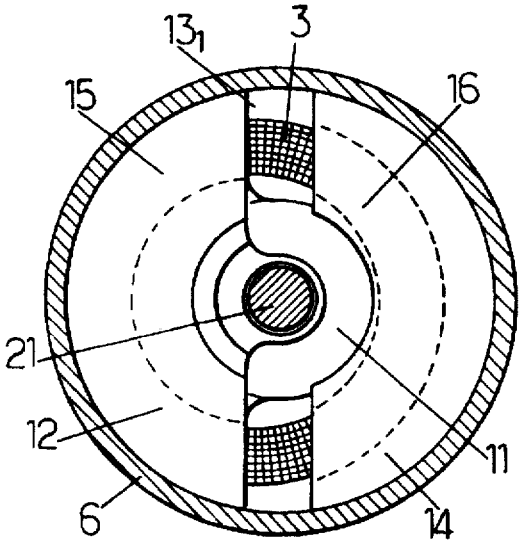
FIG.2.
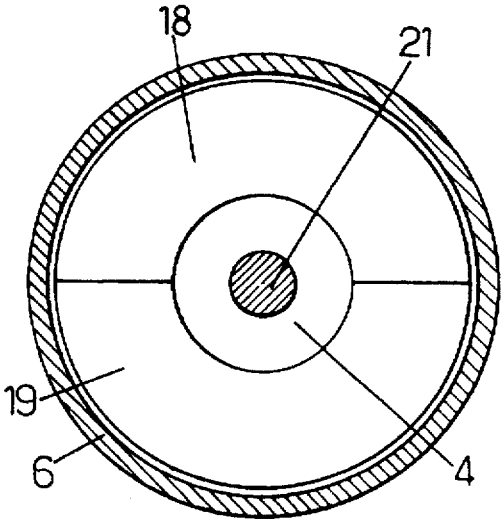
FIG.3.

LIMITED ANGULAR DEFLECTING TYPE ROTARY ELECTROMAGNETIC ACTUATOR

This invention relates generally to linked angular deflection type rotary electromagnetic actuators and, more specifically, relates to improvements to actuators of this type comprising a two-pole stator comprising a stator magnetic circuit made of a soft ferromagnetic material and having two pole shoes and an electrical energisation coil, and a rotor comprising a rotor magnetic circuit made of a soft ferromagnetic material which is situated opposite the said pole shoes of the stator magnetic circuit, which is secured to an axial shaft, and which comprises an annular two-pole magnet system.

It is known that the two fixed and movable circuits thus arranged co-operate magnetically in the region of the gap created between the two respective magnetic active surfaces each comprising two poles; the interaction of the two magnetic fields created respectively by the winding and by the magnets generates electromagnetic forces which vary according to the relative position of the two systems of two poles, which exert forces and/or tongues between the two magnetic circuits; the results is the possibility of relative displacement of the two circuits and the resulting system generates the function of a motor or actuator.

Numerous constructions of actuators thus devised are known at the present time.

However, irrespective of the vary varying forms of construction adopted for all these actuators, the standardization and arrangement of the windings are often complex and may have the disadvantage of increased production cost both in respect of the production of the coils and their fitting on the fixed magnetic circuit.

These windings may form a winding distributed after the style of a drum, which is formed on a magnetic surface whose active gap surface is cylindrical either internally or externally with insertion of the coils in notches distributed along axial generatrices of the cylinder.

The windings may also be distributed so as to form a ring-type winding which is made around a fixed magnetic circuit of toric shape with a rectangular section, the active gap surface of which may be either the inner or outer cylindrical surface of the torus or alternatively one of the side surfaces of this torus.

Other types of construction result in coils of bean shape surrounding the fixed magnetic circuit which itself has bean-shaped poles, the active gap surface being either the flat bean-shaped ends of the poles or the inner or outer cylindrical surface of said poles.

Other construction result in coils of a square or rectangular shape which surround projecting poles made in the inner cylindrical surface of the fixed magnetic circuit.

Yet another embodiment comprises making a coil concentrated on a core forming part of the fixed magnetic circuit and accommodated transversely between the poles of said magnetic circuit, the active gap surface thereof being of varying shape, more particularly one of the shapes indicated above.

Thus the construction, shaping and fitting of the windings on the fixed magnetic circuit have, in the various forms indicated above, difficulties which can be overcome but which finally lead to residual disadvantages either in use or in extra production costs.

The main object of the invention is to propose an actuator with two pairs of poles arranged in original manner and which, while satisfying the various requirements of the art in terms of performance, is of simplicity of production capable of giving a low production cost and hence suitable for large scale production while having the highest possible efficiency per unit mass.

For this purpose, a rotary electromagnetic actuator as indicated in the preamble is characterized essentially, being arranged in accordance with the invention, in that the stator magnetic circuit comprises:

- an inner pole having
  - a central core parallel to the axis of rotation and surrounded coaxially by the said coil,
  - a first pole shoe which forms an extension of the said core at one axial end of the stator circuit and which extends over an angle of approximately 180°,
  - the core and the coil being off-center relatively to the axis of rotation,
- and an outer pole having
  - a side armature in the form of a tubular sector situated outside the coil and substantially parallel to the core of the inner pole, and
  - a second pole shoe shoe which forms an extension of the said armature at the said axial end of the stator circuit and which extends over an angle of approximately 180°, and in that the ends of said central core of the inner pole and armature of the outer pole which are remote from the respective pole shoes respectively have mutual contact surfaces.

With this arrangement it is possible to increase the volume of ferromagnetic material of the stator magnetic circuit and/or the volume of the coil and hence improve the actuator torque efficiency.

The dimensioning of the various parts of the fixed magnetic circuit, particularly their section, is so devised as to ensure magnetic non-saturation.

For the construction and nature of the ferromagnetic materials used there is a choice between various technologies, e.g. machining from a solid block, casting, forging, ferromagnetic powder sintering or hot pressing with a binder, the choice being the best compromise between performance in terms of magnetic permeability and production cost.

In one embodiment which is preferred because of the restricted number of component parts of the stator circuit resulting therefrom, the outer pole has a baseplate extending substantially transversely of the side armature from the end thereof remote from the second pole shoe and against which bears the central core of the inner pole.

The rotor magnetic circuit co-operating magnetically by the active surface of its magnet poles with the surface created by the poles of the stator magnetic circuit may be in various forms adapted to the arrangement used for the stator magnetic circuit:

- the magnet poles may be situated in a planar active surface contained in a plane perpendicular to the axis of the actuator and situated at one of the ends of the fixed magnetic circuit; the movable magnetic circuit is in the form of a flat cylinder or disc, one of its planar end faces being equipped with an annular magnet system which is flat in the axial direction and which has axial magnetization, the surface thus equipped with a magnet system being disposed opposite the two poles of the fixed magnetic circuit; the gap region where the magnetic fields created by the coil and the by the magnet system interact is defined between the two active surfaces of the fixed and movable circuits;
- the magnet poles may be situated in an active surface of internal cylindrical shape coaxial with the axis of rotation and situated at one of the ends of the fixed magnetic circuit; the movable magnetic circuit is then in the form of a flat (or discoidal) element which is a cylinder of revolution and the outer cylindrical surface of which has an annular magnet system of thin radial thickness, with radial magnetization, the external cylindrical active surface of the movable magnetic circuit being disposed opposite the two poles of the fixed magnetic circuit; the gap region is defined between the two facing surfaces of the fixed and movable circuits;

the magnet poles may be situated in an active surface of external cylindrical shape coaxial with the axis of rotation and situated at one of the ends of the fixed magnetic circuit; the movable magnetic circuit is in the form of a flat (or discoidal) cylindrical body of revolution the inner cylindrical surface of which has an annular magnet system of thin radial thickness with radial magnetization, the inner cylindrical active surface of the movable magnetic circuit being disposed opposite the two poles of the fixed magnetic circuit; the gap region is defined between the two surfaces of the fixed and movable circuits.

The choice of the type of magnetic is of a technico-economic order in order to obtain an acceptable compromise between the technical performances of the actuator and the price required for this function, the choice criterion being expressed in terms of the torque delivered for a given annular travel, for a given consumed power, for a given weight and a given size and price.

Generally, to simplify the design of the system, it is advantageous for the stator and rotor circuits and the coil to be generally cylindrical bodies of revolution or similar thereto.

Advantageously, the movable magnetic circuit is secured to a shaft coaxial with the axis of rotation, which is guided in rotation by bearings secured to the fixed magnetic circuit; if required, said shaft may extend through the fixed magnetic circuit via a bore provided for the purpose so that an output shaft can be disposed at each end if considered necessary. In practice, the rotor shaft is supported by two bearings respectively secured to the end faces of a casing containing the stator and the rotor; advantageously, to facilitate assembly and maintenance, the shaft is secured to the bearing supported by the casing and face situated on the rotor side, such face being removable.

The invention will be more readily understood from the following description of some preferred embodiments which are given solely by way of example purely for illustration without any limiting force. In this description reference is made to the accompanying drawings wherein:

FIG. 1 is a diametric section of a first embodiment of a rotary electromagnetic actuator arranged according to the invention;

FIG. 2 is a section on the line II—II of the actuator shown in FIG. 1;

FIG. 3 is a section on the line III—III of the actuator shown in FIG. 1.

Figure 4:
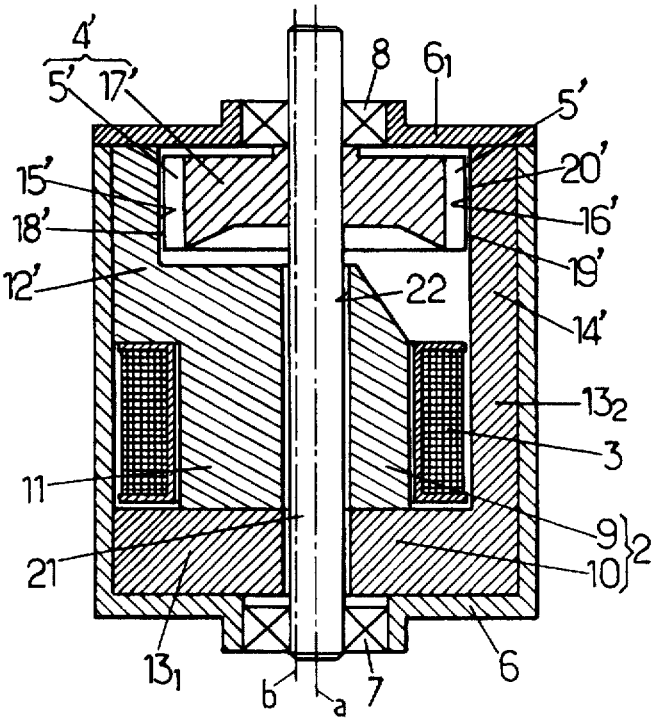
FIG. 4 is a diametric section of a second embodiment of a rotary electromagnetic actuator arranged according to the invention.

Referring to FIG. 1, 2 and 3 first of all, a limited angular deflection type rotary electromagnetic actuator having the general reference 1, comprises a fixed or stator magnetic circuit 2 equipped with a cylindircal annular coil 3, a movable or rotor magnetic circuit 4 equipped with a multi-pole magnet system 5, and a casing 6. To simplify manufacture and reduce material costs for a given force and/or torque, the actuator can be so arranged so to have the general shape of a cylindrical body of revolution, i.e., the coil, the fixed magnetic circuit and the movable magnetic circuit, together with the casing, are cylinders of revolution or are arranged on the general bases of a cylinder of revolution. This is the configuration shown in the accompanying drawings.

The fixed magnetic circuit 2 consists of two parts, namely an inner fixed pole 9 and an outer fixed pole 10, these two parts being interconnected by any suitable means (not shown). The gap between the parts 9 and 10 is designed to allow the fitting or winding of the coil 3 on the fixed magnetic circuit 2. In the embodiment shown in FIG. 1, the inner fixed pole 9 has a central core 11 which is a cylindircal body of revolution and parallel to the axis of rotation, and a pole shoe 12 which starts at a first end (the top end in the drawing) of the core 11 and extends over an angular sector which is approximately equal to (at maximum, and preferably slightly less than) 180°.

The outer fixed pole 10 comprises:

a base plate $13_1$ which faces the other end of the core 11 and is in contact therewith;

a side armature $13_2$ which extends perpendicularly to the base plate $13_1$ and concentrically to the core 11 and is in the shape of a tube sector;

a pole shoe 14, identical to the pole shoe 12 extending over an angular sector approximately equal to (at maximum, and preferably slightly less than) 180°. The two poles 12 and 14 thus formed therefore have, at the top end of the fixed magnetic circuit 2, planar active surfaces 15 and 16 respectively situated in the same plane substantially perpendicular to the axis of rotation.

In an alternative embodiment, the base plate $13_1$ could be made separately from the side armature $13_2$ to give the same facility for fitting of the coil 3 but resulting in an increased number of parts.

The component parts of the fixed magnetic circuit 2 are made from a soft ferromagnetic material, the section of the circuit in the path between the pole surfaces 15 and 16 being such that it allows the passage of the magnetic flux without saturation.

The annular coil 3, which is a cylinder of revolution, is situated on the central core 11 concentrically thereto. The ease width which this coil can be standardization will be apparent, and it lends itself perfectly to automatic large-scale production at low cost of insertion compared with windings conventionally found on this type of machine.

In another variant embodiment, the baseplate $13_1$ could be made integrally with the core 11 of the inner pole but this would result in complication in making the coil 3, which would then have to be wound directly n the core 11, hence with increased production difficulty and at greater cost.

The movable magnetic circuit 4 consists of a flat cylindrical armature 17 of soft ferromagnetic material; on its flat bottom surface (in the drawing), facing the surfaces 15 and 16 of the pole shoes 12 and 14, there is fixed an annular magnet system 5, which is axially flat and which has two-pole axial magnetization. The resulting two magnet poles therefore have their respective planar active surfaces situated in the same plane substantially perpendicular to the axis of rotation of the actuator 1; the two magnet poles are semi-annular with active surfaces 18 and 19 (see FIG. 1). The gap region 20 thus created between the active surfaces of the fixed and movable magnetic circuits is one in which the magnetic field generating the actuator driving torque interact.

A shaft 21 coaxial with the movable magnetic circuit 4 is secured axially and for rotation to the latter, provides the rotary function and transmission of the torque to the external system which is to be driven, said shaft 21 extending through the core 11 via a bore 22 parallel to the axis.

The casing 6 functionally holds together the fixed end movable magnetic circuits. A rotary bearing 7 is provided in an end face (the bottom in FIG. 1) of the casing 6 to receive for free rotation the end of the shaft 21 remote from the armature 17, while a bearing 8 is provided for the same purpose in the opposite end face of the casing. Preferably, the latter end face is made in the form of a lid $6_1$ which is detachable from the rest of the casing 6, and the shaft 21 supporting the armature 17 is retained with axial locking on the bearing 8 which is itself secured to the lid $6_1$ so as thus to form a pre-assemblable unit, which is finally mounted last on the casing 6 inside which the parts 9, 3 and 10 have been introduced and positioned.

Still with the object of simple manufacture of an annular winding preferably in the form of a cylinder of revolution and easy fitting of the winding on the central core, which is preferably also a cylinder of revolution, the attempt is also made substantially to improve the filling ratio of the complete actuator and increase the volume of ferromagnetic material in the stator magnetic circuit and/or the volume of the coil, and hence also improve the technical performance in terms of efficiency per unit mass. To this end, the assembly comprising the central core 11 and the coil 3, which are coaxial of one another, are substantially off-centered (in the direction of the left in FIG. 1), while keeping it parallel to the axis of rotation, so as to fill the are into which the side armature $13_2$ does not extend. In FIG. 1, reference a denotes the axis of rotation (axis of the shaft 21), and b denotes the axis of the coil 3 and of the central core 11.

Another embodiment of the actuator is shown in FIG. 4, in which the same numerical references, followed by a ' where applicable for those of the parts or components which have been modified, are retained to designate parts or components similar to those shown in FIG. 1. In this variant embodiment, the respective active surfaces of the fixed and movable magnetic circuits are cylinders of revolution instead of the planar surfaces of the embodiment shown in FIGS. 1 to 3; the active surfaces 15' and 16' of the poles 12' and 14' of the fixed magnetic circuit 2 are cylinders of revolution and face inwards; the active surfaces 18' and 19' of the poles 5' of the movable magnetic circuit 4' are cylinders of revolution and face outwards, these surfaces being coaxial and concentric to the axis of rotation and thus define between them a tubular gap region 20' coaxial of the axis of rotation; the circulation of the magnetic flux is affected radially in this area and no longer axially as in the embodiment shown in FIG. 1 to 3.

It will be apparent that there are resulting changes for the pole shoes 12' and 14' of the fixed magnetic circuit 2' and for the movable magnetic circuit 4', armature 17' and magnet 5', which becomes a tubular section, of thin radial thickness, radial multi-pole magnetization, which is fixed on the outer peripheral surface of the armature 17'. The rest of the actuator, and particularly the annular coil 3 fitted on the central core 11, remains unchanged.

Figure 5:
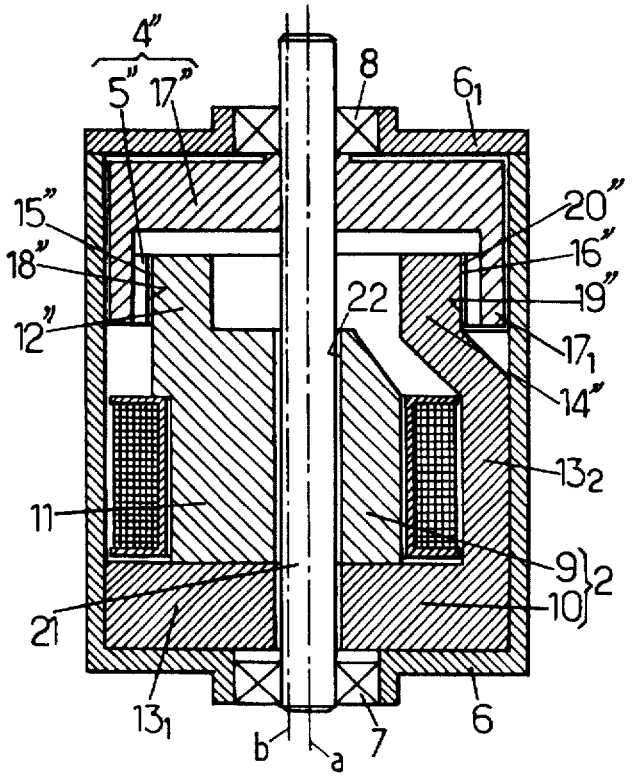
FIG. 5 is a diametric section of a third embodiment of a rotary electromagnetic actuator arranged according to the invention.

FIG. 5 shows yet another embodiment which is distinguished from that shown in FIG. 4 in that the movable magnetic circuit 4" is adapted to be disposed externally of the poles 12", 14" of the fixed magnetic circuit 2 (those parts or components which are similar to those shown in FIGS. 1 to 4 are designated by the same reference numerals, where applicable followed by " in the case of any modification). In this case, the multi-pole magnet 5" is in the form of a tubular section of thin radial thickness fixed on the inner surface of a peripheral skirt $17_1$ flanking the discoidal armature 17.

With the feature of the invention, an actuator arranged according to the invention comprises a reduced number of component parts which have only few machined surfaces and which can be readily assembled, the coil being adapted to be produced independently by an automatic process which allows its cost to be reduced. It is thus possible to make rotary electric actuators at low cost price in very large runs with performance similar to those of actuators of conventional design.

It will be obvious and also apparent from the foregoing that the invention is in no way limited to those of its applications and embodiments which have been considered more particularly and that on the contrary it covers all variants thereof.

I claim:

1. A rotary electromagnetic actuator comprising:

an axial shaft which rotates about a rotation axis;

a two-pole stator including an electrical energization coil, said coil being off-center relative to the rotation axis;

a stator magnetic circuit made of a soft ferromagnetic material and having (a) an inner pole having a central core parallel to the rotation axis and surrounded coaxially by said energization coil, said central core being off-center relative to said rotation axis; and a first pole shoe which forms an extension of said core at one axial end of said stator magnetic circuit and which extends over an angle of approximately 180°;

(b) an outer pole having a side armature in the form of a tubular section situated outside of said coil and being substantially parallel to said core; and a second pole shoe which forms an extension of said armature at the one axial end of said stator magnetic circuit and which extends over an angle of approximately 180°, and (c) a first contact surface of an end of said central core of said inner pole remote from said first pole shoe and a second contact surface at an end of side armature of said outer pole remote from said second pole shoe, which said first and second contacts surfaces are mutually in contact; and a rotor secured to said axial shaft and including a rotor magnetic circuit made of a soft ferromagnetic material which is situated opposite to said first and second pole shoes, said rotor magnetic circuit including an annular two-pole magnet system.

2. A rotary electromagnetic actuator as claimed in claim 1, wherein the outer pole has a baseplate extending substantially transversely of the side armature from the end thereof remote from the second pole shoe and against which bears the central core of the inner pole.

3. A rotary electromagnetic actuator as claimed in claim 1, wherein the first and second pole shoes have respective shoe surfaces substantially perpendicular to the rotation axis;

wherein said rotor magnetic circuit includes a facing surface substantially parallel to the shoe surfaces; and wherein the annular two-pole magnet system in flat and fixed on the facing surface of the rotor magnet circuit.

4. A rotary electromagnetic actuator as claimed in claim 1, wherein the first and second pole shoes have respective shoe surfaces substantially perpendicular to the rotation axis and extending over concentric arcs of a circle mutually facing one another;

wherein the rotor magnetic circuit is a cylindrical body of revolution and engaged between the pole shoes; and wherein the annular two-pole magnet system is a tubular section fixed on a peripheral surface of the rotor magnetic circuit which is a cylindrical body of revolution and engaged between the pole shoes.

5. A rotary electromagnetic actuator as claimed in claim 1, wherein the first an second pole shoes have shoe surfaces which are respectively substantially parallel to the rotation axis and extend over concentric arcs of a circle back to back;

wherein the rotor magnetic circuit straddles the first and second pole shoes and has a cylindrical skirt of revolution extending opposite respective outer surfaces of the first and second pole shoes; and wherein the annular two-pole magnet system is a tubular section fixed on an inner surface of the cylindrical skirt.

6. A rotary electromagnetic actuator as claimed in claim 1, wherein the stator and rotor magnetic circuits and the coil are generally in the form of cylindrical bodies of revolution or are similar to cylinders of revolution.

7. A rotary electromagnetic actuator as claimed in claim 1, wherein the inner pole has a bore extending through the central core for free-rotation passage of the rotor shaft.

8. A rotary electromagnetic actuator as claimed in claim 6, wherein the shaft is supported by two bearings; and further including a casing containing the stator and the rotor and having two respective end faces to which said two bearings are respectively secured.

9. A rotary electromagnetic actuator as claimed in claim 8, wherein the end face adjacent the rotor is removable.

* * * * *